US006307464B1

(12) United States Patent
Miller et al.

(10) Patent No.: US 6,307,464 B1
(45) Date of Patent: Oct. 23, 2001

(54) METHOD AND APPARATUS USING PHASES FOR COMMUNICATION IN THERMOSTAT CIRCUIT

(75) Inventors: Mark E. Miller, Versailles; Timothy L. Anderson; Ronald E. Garnett, both of Lexington, all of KY (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/563,081

(22) Filed: May 1, 2000

Related U.S. Application Data

(60) Provisional application No. 60/172,876, filed on Dec. 20, 1999.

(51) Int. Cl.[7] ..... H04M 11/04

(52) U.S. Cl. ..... 340/310.01; 340/310.06; 340/310.07; 340/653; 318/672

(58) Field of Search ..... 340/310.01, 310.06, 340/310.07, 310.08, 607, 653, 654, 655, 657, 658; 318/672

(56) References Cited

U.S. PATENT DOCUMENTS 4,604,619 * 8/1986 Goodwater ..... 340/825.18
4,889,179 * 12/1989 Merenda ..... 165/14
4,992,774 * 2/1991 McCullough ..... 340/310.01
5,386,185 * 1/1995 Beck et al. ..... 318/762
5,461,368 * 10/1995 Comer ..... 340/607
5,506,569 * 4/1996 Rowlette ..... 340/577
5,572,104 11/1996 Nold et al. .
5,604,424 * 2/1997 Shuttleworth ..... 323/258
6,236,552 * 5/2001 Hattori ..... 361/160

* cited by examiner

*Primary Examiner*—Nina Tong
(74) *Attorney, Agent, or Firm*—Russell E. Baumann; Frederick J. Telecky, Jr.

(57) ABSTRACT

In a receiver circuit module (22) having a microcontroller (U1), an output line (FILTER_LED) connectable to a source circuit module (20) is also used as an input. A switch (SW2) disposed in the source circuit module is closed to change the wave form which is read by the microcontroller as an input signal to drive a 5V signal to the gate of a solid state switch (Q1) turning it on to thereby energize an output device in the source circuit module via the same output line (FILTER_LED). By means of the dual function of the output line the control can notify a user of an HVAC system, for example, of system problems with a blinking light and/or an audible alarm as well as serving to notify the user at a remote location that selected maintenance is due, such as a need to change filters without additional control lines. The source circuit module can be mounted near the thermostat of the HVAC system or on the central heating and cooling unit.

10 Claims, 6 Drawing Sheets

METHOD AND APPARATUS USING PHASES FOR COMMUNICATION IN THERMOSTAT CIRCUIT

This application claims benefit of application 60/172,876 filed Dec. 20, 1999.

FIELD OF THE INVENTION

This invention relates generally to heating and cooling systems for buildings and the like and more particularly to thermostat circuits used with a microcontroller based controller for such systems.

BACKGROUND OF THE INVENTION

In present residential HVAC (heating, ventilating and air conditioning) systems a 24 volt AC signal is sent from a wall thermostat to a receiving control. The control either reads the signal as ON or the signal is used to directly turn on a 24 VAC electromechanical device. The signal is read as ON or OFF depending on the presence of the 24 VAC with respect to ground. For each function added, e.g., each electromechanical device added, typically at least one new wire is provided.

SUMMARY OF THE INVENTION

It is an object of the present invention to add functions while minimizing the wires needed. Another object is the provision of a control in which functions are added without adding wires.

Briefly described, the invention uses the same 24 VAC signal and substantially the same wiring as in conventional controls but reads the signal in a different way. A receiving control is employed using a full wave power supply which provides a logic ground which is different from earth ground in the 24 VAC control. The logic ground is at a different potential from earth ground (24 VAC ground) and is a different potential from 24 VAC. The invention takes advantage of the ability to read the 24 VAC signal as potentially four different states by using a microcontroller.

Since the voltages are compatible with 24 VAC and 24 VDC components, the circuit on this line is capable of driving these loads as well as reading the status of switches. Extra wiring is avoided by using one wire in a dual function, i.e., as both an input as well as an output. The phasing and the circuit is used so that when a switch is pressed, the microcontroller uses a line normally used as an output as an input. In the preferred embodiment, this is used in a diagnostic circuit to alert a user of the HVAC unit of system problems with a blinking light and/or an audible alarm. The indicator light and alarm can be mounted near the thermostat or on the HVAC unit, as desired.

Additional objects and features of the invention will be set forth in part in the description which follows and in part will be obvious from the description. The objects and advantages of the invention may be realized by means of the methods, means of instrumentalities and combinations, particularly pointed out in the appended claims.

DETAILED DESCRIPTION OF THE PREFERRED EMBODIMENT

Figure 1:
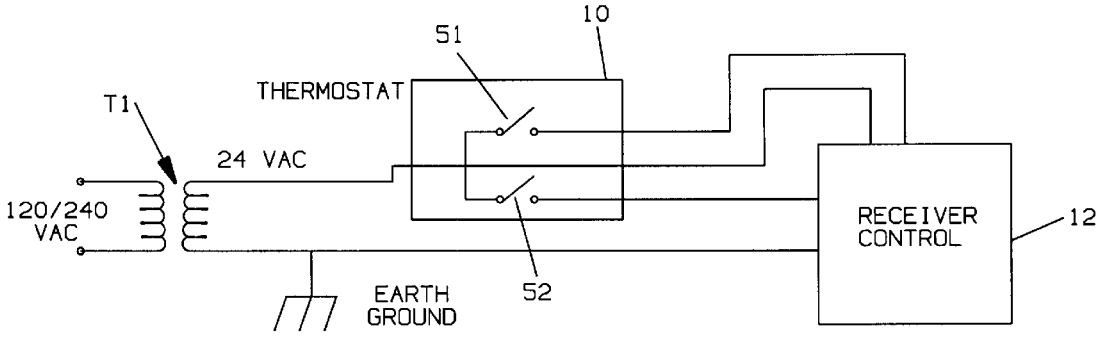
PRIOR ART FIG 1
FIG. 1 is a is a schematic diagram of a typical prior art 24 VAC control system.

With reference to FIG. 1, a typical 24 VAC control system is shown comprising a thermostat 10 depicted in dashed lines and receiver control 12 coupled to a transformer T1. In presently existing residential control techniques, a 24 volt AC signal is sent from wall thermostat 10 to the receiving control 12. The control reads the signal as ON when one of S1, S2 switches are closed or OFF when the switches are open, that is, as shown depending on the presence of the 24 VAC with respect to earth ground. Alternatively, the signal can be used to directly turn on a 24 VAC electromechanical driver (not shown).

Figure 2:
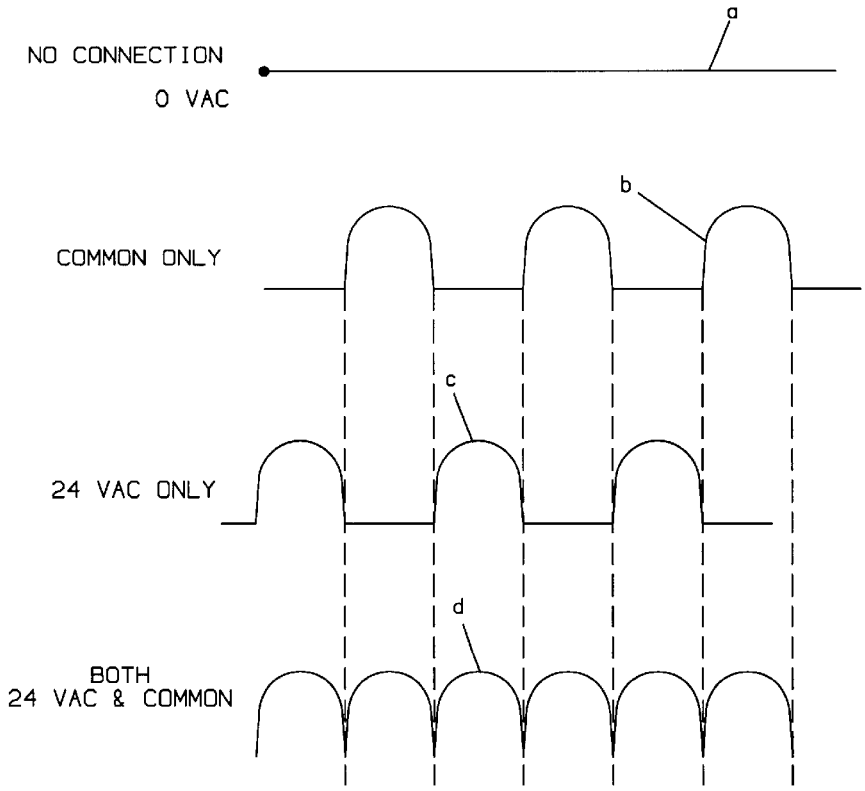
FIG. 2 is a diagram showing signals with respect to logic ground.

A control made in accordance with the invention can use the same 24 VAC signal and substantially the same wiring but reads the signal in a different way. The receiving control made in, accordance with the invention uses a full wave power supply. This power supply results in a logic ground that is different from the earth ground used in the FIG. 1 24 VAC control. The logic ground is at a different potential from earth ground (24 VAC ground) and is a different potential from 24 VAC. With respect to logic ground such signals are shown in FIG. 2 showing signal a, no connection at 0 VAC; signal b, common only; signal c, 24 VAC only; and signal d, both 24 VAC and common.

Figure 3:
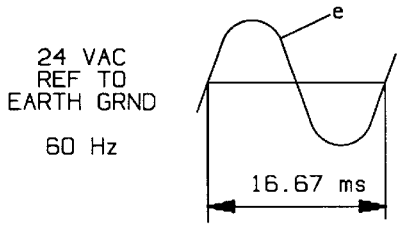
FIG. 3 is a diagram showing 24 VAC referenced to earth ground.
Figure 4:
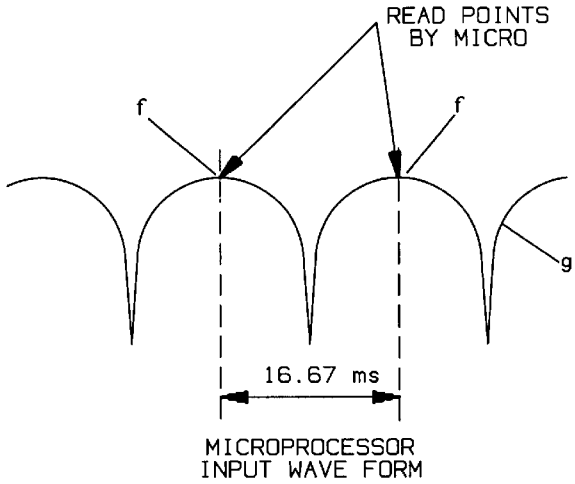
FIG. 4 is a diagram showing a microprocessor input wave form.
Figure 5:
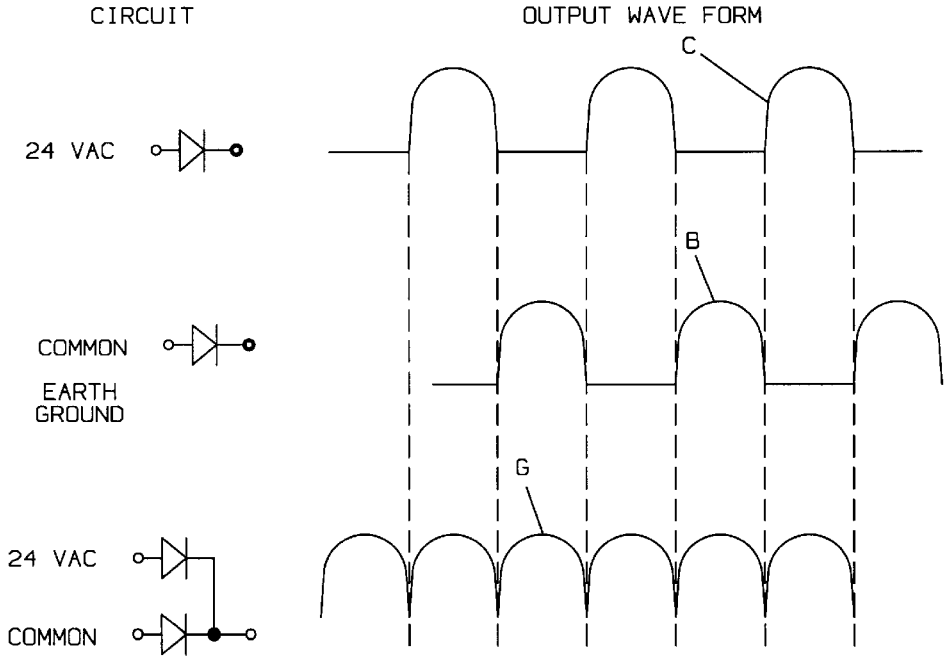
FIG. 5 is a diagram showing output wave forms for several circuit configurations.

A control made according to the present invention takes advantage of the ability to read the 24 VAC signal as potentially 4 different states. As will be explained in greater detail below, the receiving control has 24 VAC supplied to it from a common 24 VAC system transformer. The control has a "reference" supplied to it from the connection to 24 VAC power and earth ground. Using either 24 VAC or earth ground as a reference, the control can use the reference to decipher which phase input is being sent to the control. The ability to read these inputs during each phase is made possible and feasible by use of a microcontroller. The microcontroller has its own oscillator clock. The clock is used to time the AC wave form and to take readings during each quarter wave point, i.e., 180° apart. In this connection, reference may be had to FIG. 3 which shows a 60 Hz, 24 VAC wave e referenced to earth ground, and FIG. 4 which illustrates the points f read by the microcontroller each quarter cycle of an input wave form g comprising both 24 VAC and common. Generation of these signals are obtained by adding discrete components in the form of diodes to the control as illustrated in FIG. 5 in which a diode in the 24 VAC line provides an output wave form c; a diode connected to common provides an output wave form b; and a diode in both the 24 VAC line and in common provides an output wave form g.

Figure 6:
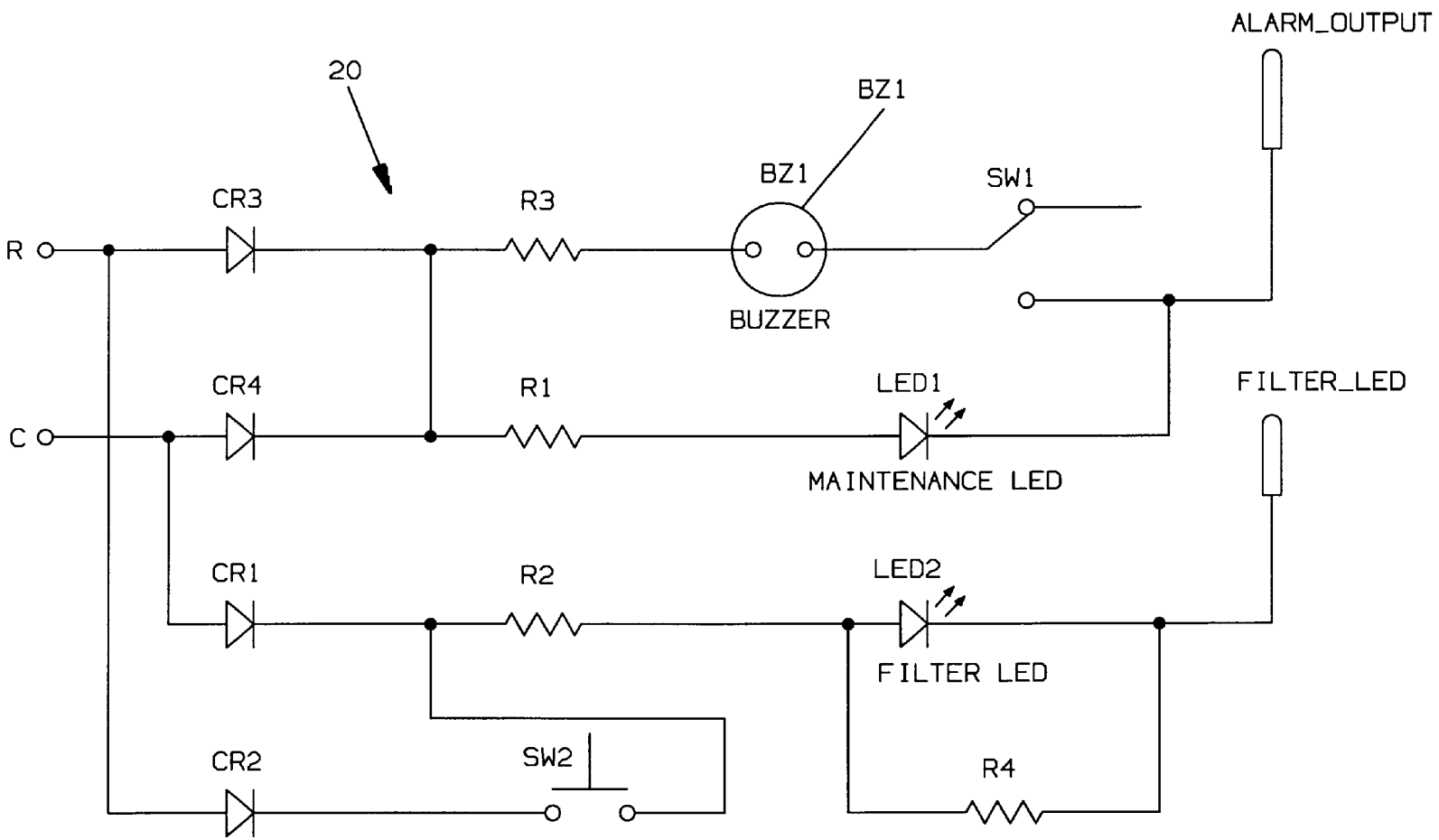
FIG. 6 is a diagram of a source circuit used in a control system made in accordance with the invention.

In addition to the multiple 24 VAC signals on the same signal line, a diagnostic control made using the present invention also uses one of these signals as a power source to drive an LED indicator. On a source or generator module such as shown in FIG. 6, an LED is turned ON and OFF by the driver on the receiver board. During the OFF cycle, the receiver control looks at the control line as an input. It uses this period to determine if the switch is being pushed. When the switch is pushed, the signal changes from a half wave Common (C) input, to a Full wave R and C input. The use of these 24 VAC control lines as multiple inputs and outputs on a single line makes this useful for the residential HVAC market, for example. It is a very low cost method to communicate without adding wires. This is a requirement to retrofit existing systems.

Figure 7:
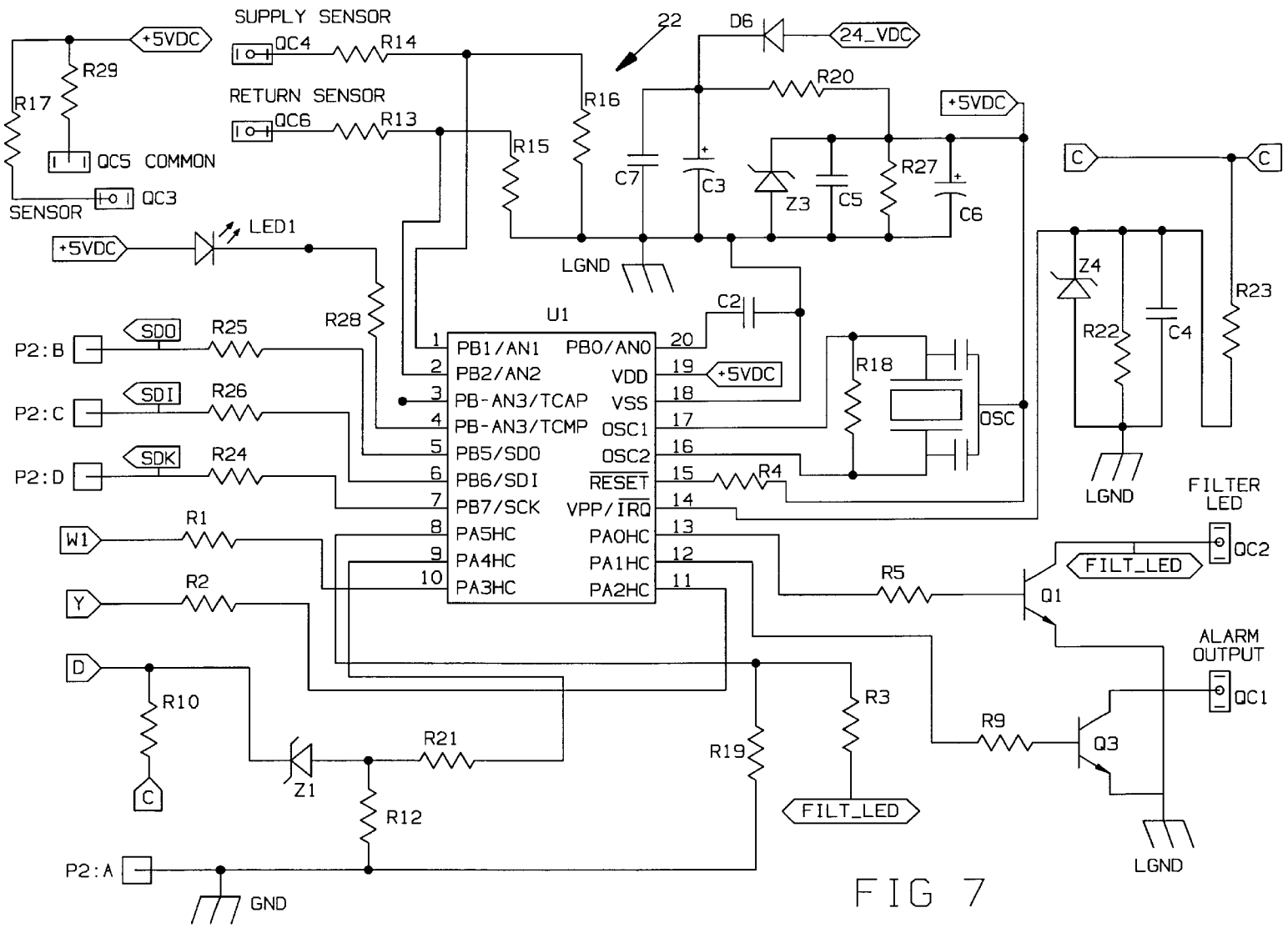
FIG. 7 is a diagram of a receiver circuit used in a control system made in accordance with the invention.

With reference to FIGS. 6 and 7, the diagnostic control can be broken down into two parts: the source circuit 20, FIG. 6 and the receiver circuit 22, FIG. 7. There is a dynamic two-way communication between the two modules. The source circuit provides an interface to the end customer and the receiver control is the main system board.

The source circuit has four terminals connected to it. The R-C terminals are the low voltage 24 VAC power supply terminals and ALARM_OUTPUT and FILTER_LED are connected to the receiver board. The 24 VAC is rectified through four diodes, CR1, CR2, CR3, CR4, to create a full-bridge rectification. The full-bridge rectification with a 24 VAC input creates a DC voltage power supply that drives the piezo-ceramic buzzer BZ1. A 2.0 K Ohm resistance R3' is a current limiting device to ensure the correct load across the buzzer. The DC voltage power supply also supplies power to a red diode LED1' which is also current limited by a 10 K Ohm resistance R1'. Because the source circuit is an interface to the end customer, a switch SW1 is provided to disable the buzzer. The low or ground side of the buzzer has a connection point ALARM_OUTPUT to the receiver board. Whenever the buzzer and LED1' are to be enabled, the receiver module switches these outputs on through the "ALARM_OUTPUT" line. Thus, the outputs of the receiver circuit at QC1, "ALARM_OUTPUT", and QC2, "FILTER_LED", to be discussed, are connected to the source circuit. These outputs are respectively driven by Q3 at pin 12 and Q1 at pin 13 of microcontroller U1.

The receiver control 22 is supplied with 24 VDC through diode, D6. A +5 VDC provided to U1 is sustained through the 5 V power supply circuit of zener diode Z3, capacitor C5, resistor R27 and capacitor C6. The negative half-wave, C, is read as ON and OFF into pin 14 of microcontroller U1 by zener diode Z4, resistors R22 and R23 every 16.7 ms or 60 cycles per second. This interrupt is used to calibrate all timings and read all other inputs. The +5VDC power supply also provides power to read the external sensors, SUPPLY SENSOR QC4, QC5 and RETURN SENSOR QC6, QC3, through resistors R29 and R14, pin 1 of microcontroller U1, and through resistors R17 and R13, pin 2 of microcontroller U1, respectively. When the temperature of these sensors change, the resistance changes causing the voltage to change at these pins. The voltage change is an input to U1 for the built-in analog-to-digital converter.

The other inputs read into microcontroller U1 come from the wall thermostat. These inputs are "O" at pin 9, "Y" at pin 11, and "W1" at pin 10 of microcontroller U1.

The diode logic of diodes CR1 and CR2 provides phasing communication between the source and receiver boards. The "FILTER_LED" line is utilized to read either one or both phases of the alternating current, AC, waveform. The receiver circuit determines whether the switch, SW2, is being closed because switch closing sends the positive phase, R, to the control. The 2.0 K Ohm resistance, R2', is a current limiting device for the yellow diode, LED2', labeled as "FILTER_LED". The 10 K Ohm resistance, R4', provides a voltage divider to ensure the correct voltage across LED2.

The "FILTER_LED" connection point from the source to the receiver control is also used as an input. The U1 microcontroller at pin 13 uses this line to turn on light emitting diode LED2' but also, the phasing communications allows this same connection point to be an input. The switch SW2 is read into pin 8 of microcontroller U1. The 300 K Ohm, resistance R3, and 100 K Ohm, resistance R19, provide the voltage divider input to microcontroller U1. The software algorithm in the microcontroller allows these dual capabilities.

Figure 8:
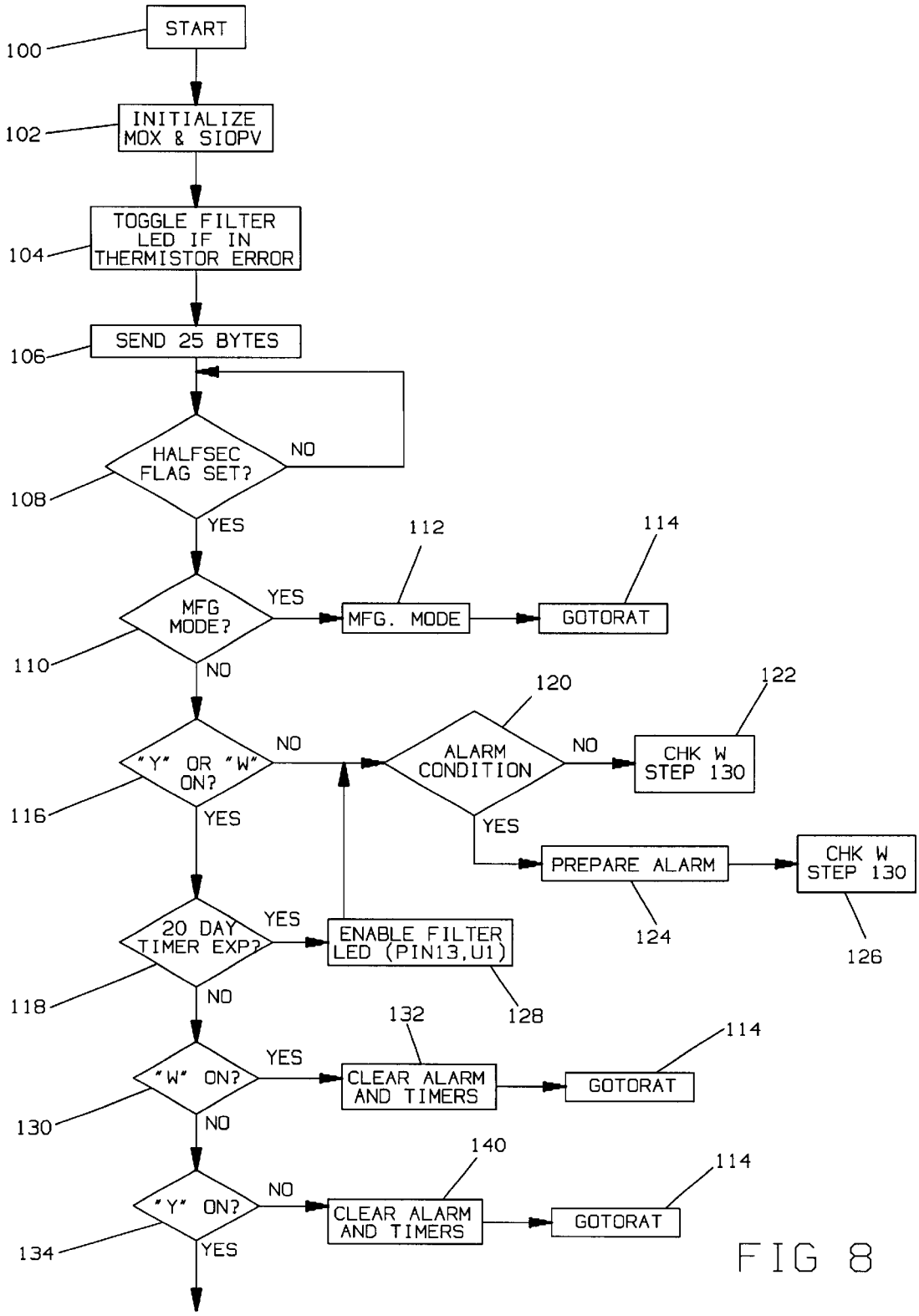
FIGS. 8 and 9 are flow charts of the main routine used in practicing the invention.
Figure 9:
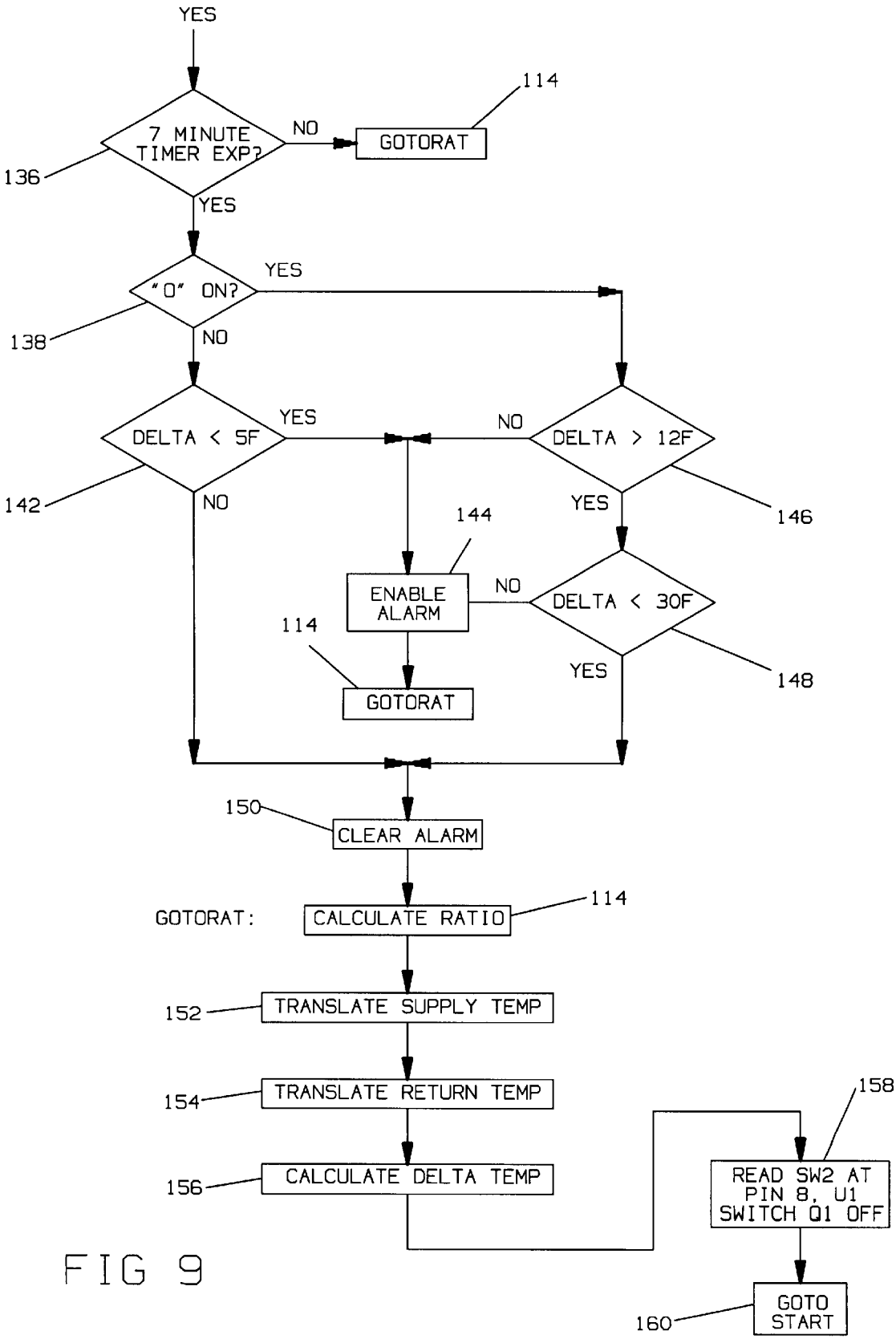

With respect to FIGS. 8 and 9, the main routine of the system's algorithm starts at 100 and initializes the analog/digital multiplexer and serial port interface (SI10PV) at 102. After initialization, the system checks the integrity of the two sensors. If either sensor has failed, open or shorted, the receiver circuit toggles the FILTER_LED at 104, half second ON, half second OFF. This provides a user interface to ensure that sensors are operating correctly. Microcontroller U1, at step 106, sends out 25 bytes of data on pin 5 (serial data out) and pin 7 (serial clock output).

Decision step 108 determines whether a half second flag has been generated and, if not, the routine cycles through step 108 until the flag is set. Once this occurs, decision step 110 determines if the system is in the manufacturing mode and, if so, the receiver control runs a speed-up automated manufacturing test code at step 112, then going to step 114 "GOTORAT" to calculate the ratio. If the system is not in the manufacturing mode, step 116 detects whether there is a "Y" or a "W" input signal from the wall thermostat. If either of these inputs is ON, then a 20 day timer is incremented and decision step 118 determines whether the 20 day timer has expired. Going back to decision step 116, if the "Y" or the "W" is not ON and an alarm condition exists, step 120, then the output driver is prepared for the "ALARM" at step 124, and the routine goes to step 130 (steps 122, 126) which checks to see if "W" is on. When the 20 day timer has expired at step 118 then, at step 128, the "FILTER_LED" on pin 13 of microcontroller U1 is enabled and the routine goes back to decision step 120. With a negative response at decision step 118, the routine goes to decision step 130. At step 130 (CHK_W) a "W" input ON will clear any alarm conditions and all timers at step 132 before going to "GOTORAT", step 114. If the decision at step 130 is negative then decision step 134 determines whether the "Y" signal is ON and if so a 7 minute timer begins and upon expiration at step 136, decision step 138 determines whether the "O" signal is ON. If the "Y" signal is not ON at step 134 then the alarm and timers are cleared at step 140 with the routine going to "GOTORAT", step 114. If the 7 minute timer has not expired in decision step 136, the routine goes to "GOTORAT" at step 114.

Decision step 138 determines whether the system is in the cooling mode ("O" ON) or the heating mode ("O" OFF). If in the heating mode, "O" not ON, then the system will enable the alarm at step 144 if the delta temperature, which is the difference between the supply and return sensors, is less then 5° F. (step 142). If the system is in the cooling mode, "O" ON, then the system will enable the alarm if the delta temperature is not greater than 12° F. or is equal to or greater than 30° F. steps 146, 148. Following step 144 the routine goes to "GOTORAT", step 114.

Following negative decisions at steps 142, 148 the routine goes to process step 150 which clears the alarm indicating the system is performing correctly. The ratiometric numbers of the supply and return sensor to the reference resistance are calculated at step 114. Once the ratiometric numbers are computed, the value must go to a look-up table for translation into degrees Fahrenheit, steps 152, 154. The number translated from the look-up table is used to compute the delta temperature at 156.

Using phasing for communication occurs when at step 158, switch SW2 is closed. Microcontroller U1 always turns off Q1 to read whether the positive phase of the 24 VAC is present on pin 8. The system utilizes the "FILTER_LED" line to read SW2 and to also drive Q1. Once this check is complete, the algorithm goes to 160 and then back to 100 to complete the cycle again.

Source and receiver circuit modules 20, 22 respectively, made in accordance with the invention included the following components:

| | | |
|---|---|---|
| Microcontroller U1 | MC68HC705JJ7 | Resistor R1' 10K, ¼ W |
| Diode CR1–CR4 | IN4007 | Resistor R2' 2.0K, ¼ W |
| Diode D6 | IN4007 | Resistor R3' 2.0K, ¼ W |
| Light Emitting Diode LED1 | 100K, ¼ W | Resistor R4' 10.0K, ⅛ W |
| Light Emitting Diode LED1' | 100K, ¼ W | Zener Diode Z1, 12 V |
| Light Emitting Diode LED2' | 300K, ¼ W | Zener Diode Z3, 5.1 V |
| Resistor R1 | 10K, ⅛ W | Zener Diode Z4, 5.1 V |
| Resistor R2 | 2K, ⅛ W | Capacitor C2 - .47 uF, 100 V |
| Resistor R3 | 2K, ⅛ W | Capacitor C4 - .01 uF, 50 V, 10% |
| Resistor R4 | 1.5K, ⅛ W | Capacitor C5 - 1 uF, 50 V, 10% |
| Resistor R5 | 10K, ⅛ W | Oscillator OSC, OSC caps |
| Resistor R9 | 1K, ¼ W | Transistor Q1, MP SA 06 |
| Resistor R10 | 1K, ¼ W | Transistor Q3, MP SA 06 |
| Resistor R12 | 10K, ¼ W | Buzzer BZ1, SPB 14 |
| Resistor R13 | 10K, ¼ W | Switch SW1, 065T-SPDT-A |
| Resistor R14 | 1K, ¼ W | Switch SW2, TL59DF100Q |
| Resistor R15 | 1M, ⅛ W (Optional) | |
| Resistor R16 | 100K, ⅛ W | |
| Resistor R17 | 1.5K, 2 W | |
| Resistor R18 | 100K, ¼ W | |
| Resistor R19 | 100K, ⅛ W | |
| Resistor R20 | 100K, ⅛ W | |
| Resistor R21 | 2K, ¼ W | |
| Resistor R22 | 2K, ¼ W | |
| Resistor R23 | 2K, ¼ W | |
| Resistor R24 | 2K, ⅛ W | |
| Resistor R25 | 2K, ⅛ W | |
| Resistor R26 | 1K, ¼ W | |
| Resistor R27 | C5 1 uF, 50 V, 10% | |
| Resistor R28 | C6 10 uF, 16 V | |
| Resistor R29 | C7 1 uF, 50 V, 10% | |

Although the invention has been described with respect to a specific preferred embodiment thereof, variations and modifications will become apparent to those skilled in the art. It is, therefore, the intention that appended claims be interpreted as broadly as possible in view of the prior art to include all such variations and modifications.

What is claimed:

1. A method for two way communication between first and second circuit modules, the first circuit module having a microcontroller with inputs and outputs comprising the steps of taking a microcontroller controllable switch and serially connecting it to an output line extending between an output connection point and logic ground, controlling the state of energization of the switch by the microcontroller, connecting the output connection point to an input of the microcontroller through a voltage divider, the second circuit module having an output device, providing a full wave rectified power source and connecting the rectified power to the output device and to an output connection point, reading the wave form at the said input of the microcontroller on a continuing basis and selectively changing the wave form on the output line in the second circuit module to thereby use the output line as an input signal to the microcontroller, the microcontroller, in response to reading a change in the wave form actuating the microcontroller controllable switch to allow current to flow in the output line through the output device to thereby use the output line as an output.

2. A method according to claim 1 in which the wave form on the output line is changed by connecting the rectified power source line with the rectified common line through a bridging switch.

3. A method according to claim 2 in which the output device is a light emitting diode.

4. Apparatus having two way communication between two circuit modules comprising a first circuit module having a microcontroller with input and output ports, a power source having a logic ground, an output line serially connected to a microcontroller controllable switch between a connection point and ground logic, a voltage divider comprising resistors coupled between the connection point and logic ground connected to an input port and the microcontroller controllable switch connected to an output port, a second circuit module having an AC power source with a signal line and an earth ground line, respective rectifying diodes connected to the signal line and the earth ground line, an output device serially connected in one of the rectified signal and earth ground lines and a selectably actuatable switch connected between the other of the rectified signal and earth ground lines and the high voltage side of the output device, actuation of the selectably actuatable switch in the first circuit module changing the wave form which is read by the microcontroller as an input signal for the microcontroller to operate the microcontroller controllable switch to conduct current thereby energizing the output line device in the second module with the output line being used both as an input line and as an output line.

5. Apparatus according to claim 4 in which the output device is a light emitting diode.

6. Apparatus according to claim 4 in which the rectifying diodes comprise a portion of a full wave bridge and another output device is connected in another one of a rectified signal and earth ground lines.

7. Apparatus according to claim 6 in which the said another output device comprises a buzzer.

8. Apparatus according to claim 7 further comprising selected sensors connected to input ports of the microcontroller.

9. Apparatus according to claim 6 further comprising a manually operable switch serially connected to the buzzer to permit a user to disable the buzzer.

10. Apparatus according to claim 4 in which the selectably actuatable switch is a manually operable switch.

* * * * *